United States Patent [19]

Johnson

[11] Patent Number: 5,009,217

[45] Date of Patent: Apr. 23, 1991

[54] FIREPLACE LOG HOLDER AND ALARM

[76] Inventor: Hewitt M. Johnson, Rte. 2, Box 68, Lebo, Kans. 66856

[21] Appl. No.: 506,220

[22] Filed: Apr. 9, 1990

[51] Int. Cl.[5] ..... F23H 13/00; G08B 3/02; G10K 1/06

[52] U.S. Cl. ..... 126/152 B; 126/298; 116/67 R; 116/169

[58] Field of Search ..... 116/169, 67 R; 126/152 B, 298, 540, 541, 544; D23/403, 407, 397, 398

[56] References Cited

U.S. PATENT DOCUMENTS

| | | | |
|---|---|---|---|
| 658,295 | 9/1900 | Sullivan | 126/544 |
| 969,953 | 9/1910 | Heller | 126/298 |
| 1,727,817 | 9/1929 | Evans | 126/298 |
| 4,136,677 | 1/1979 | Mayes | 126/298 |
| 4,262,651 | 4/1981 | Fajt | 126/202 |
| 4,471,757 | 9/1984 | Rogers | 126/152 B |
| 4,503,782 | 3/1985 | Helton | 110/186 |
| 4,599,989 | 7/1986 | Telfer | 126/298 |
| 4,771,760 | 9/1988 | Whiteley | 126/298 |

*Primary Examiner*—William A. Cuchlinski, Jr.
*Assistant Examiner*—John Beres
*Attorney, Agent, or Firm*—D. A. N. Chase

[57] ABSTRACT

A fireplace log holder and alarm system is designed for placement within the firebox of fireplaces. The log holder is comprised of parallel log supports having a very rough top surfaces so as to minimize rolling and slippage of the logs. Attached to the front of the log supports is the alarm mechanism which includes metal uprights having eyes in their upper ends. An elongated hollow metal tube spans the eyes of the uprights and is loosely received within them. During the course of combustion as logs shift and are partially consumed, any forwardly shifting log will precipitously contact the metal uprights or the metal tube and cause the tube and uprights to strike together. This rapid striking action generates a loud noise which serves to notify the occupants of the dwelling that log shifting has occurred and that a dangerous repositioning of burning logs demands their attention.

6 Claims, 1 Drawing Sheet

FIREPLACE LOG HOLDER AND ALARM

BACKGROUND OF THE INVENTION

This invention relates to a fireplace log support having an alarm to notify the occupants of a dwelling of shifting or falling logs. In particular the invention provides for a log support which will produce a warning sound when a partially burned log shifts to a dangerous position at the front of the fireplace. Such movement causes the partially burned log to precipitously make contact with an alarm component that generates the audible warning.

It has long been known that for efficient combustion to take place in indoor fireplaces support of the logs is necessary. This is accomplished by a variety of well known methods which permit multiple logs to be stacked upon one another and raise them above the floor of the firebox to allow circulation of air for efficient combustion.

A common difficulty in the stacking of fireplace logs to promote combustion is the falling or settling of logs as combustion takes place. During the course of burning the logs change in size and shape and begin to shift within the fireplace allowing logs higher up in the stack to fall forward. The potential exists for forwardly shifting logs to come near the front of the fireplace or the hearth or even roll out from the confines of the firebox. This movement of the burning logs and the heat associated therewith can result in a highly dangerous situation which may cause the ignition and burning of articles near the fireplace hearth and have catastrophic results for the house occupants.

While a variety of means have been developed to contain fireplace logs within the fireplace area they do not notify the residents of the home or building that such log shifting has taken place. As a result a log may come dangerously near other flammable articles proximate to the front of the fireplace without the residents having any warning of the danger.

Several difficulties are presented in developing a suitable containment device. It must be able to withstand the high temperatures associated with close proximity to a wood burning fire and be capable of normally restraining the falling logs so that they do not pass beyond the protected area of the fireplace. Also, the proximity to the burning fire and the short distance between safety and danger renders it difficult to employ a heat sensor capable of distinguishing between a safely burning fire and a fire which has moved dangerously close to the front of the fireplace, without significant expense to achieve the intended result.

Therefore, it is a principal objective of the present invention to provide a fireplace holder and alarm which is inexpensive and which can withstand the high temperatures of close proximity to a wood burning fire.

It is another object of the present invention to provide notice to the occupants of a dwelling that log shifting in a fireplace has occurred and that attention to the fireplace is required.

A further objective of the present invention is to retain falling or shifting logs within the fireplace area while at the same time notifying the residents that such shifting has occurred.

Another object of the present invention is to produce a warning sound as a result of falling or shifting logs that can be heard outside of the room containing the fireplace so as to notify the occupants of a dangerous fireplace situation.

Yet another objective of the present invention is to provide for a fireplace log holder and alarm which minimizes obstruction of the view of the fireplace and obstruction to heat radiation into the room.

Other objects and advantages of this invention will become apparent from the following description taken in connection with the accompanying drawings wherein are set forth by way of illustration and example a preferred embodiment of this invention.

DESCRIPTION OF THE PREFERRED EMBODIMENTS

Figure 1:
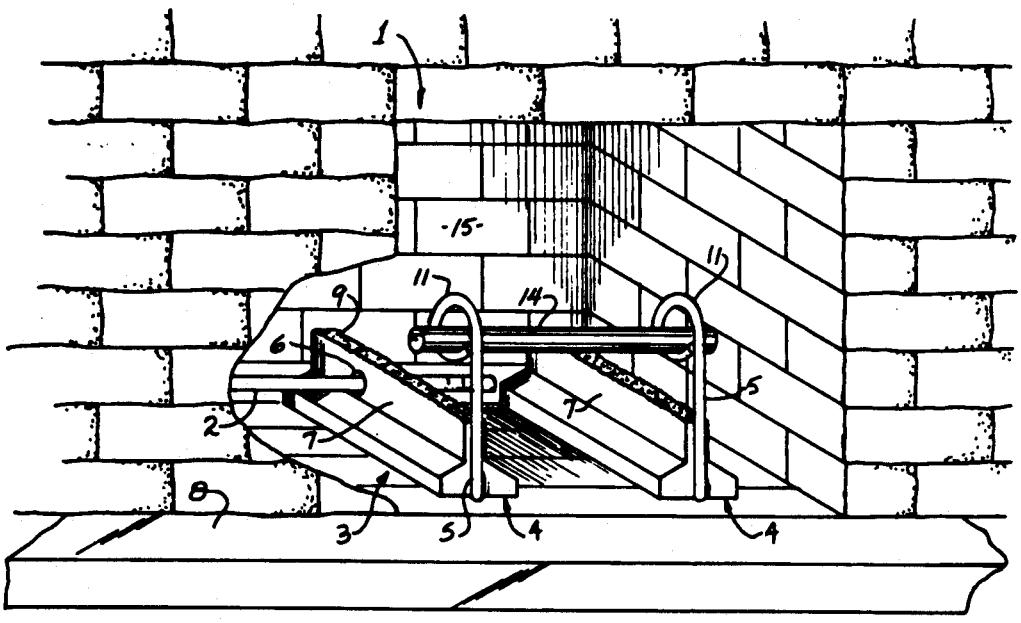
FIG. 1 is a perspective view of the preferred embodiment of the invention within the firebox of a fireplace having a portion of the fireplace wall broken away, and showing placement of the alarm tube within the eyes of the upright rods.
Figure 2:
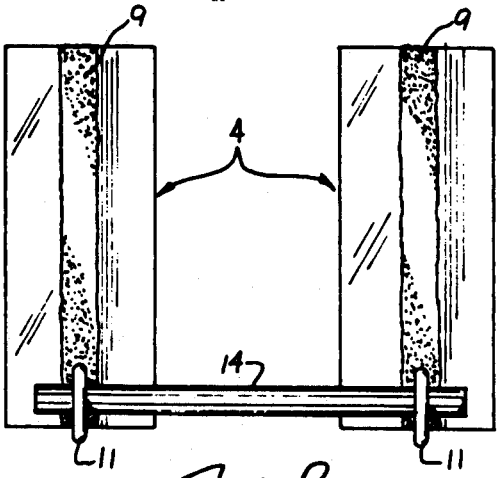
FIG. 2 is a plan view of the preferred embodiment.

Reference is made to FIG. 1 showing in perspective view the preferred embodiment within a fireplace or firebox 1 having a hearth 8 along the front edge of the fireplace. A log support 3 within the fireplace is provided by two spaced apart, parallel lengths of railroad rails 4. The parallel railroad rails 4 extend longitudinally from the rear of the firebox 1 to the front. The log support 3 is constructed by cutting two portions of railroad rail to near equal lengths and then removing the head or ball of the rail such that a relatively flat surface is presented upon which the logs may rest. Removal of the head of the rail is accomplished in rough fashion by use of a cutting torch so as to leave the top of each rail web 7 with a rough irregular surface 9 (FIG. 2) to prevent shifting and movement of logs loaded onto the log support members. A fire starting gas jet 2 may be utilized in conjunction with the invention as is shown located towards the rear of the left rail 4 by the inclusion of a through-hole 6 in the web 7.

Attached to the rails 4 are a pair of uprights 5 which are constructed of ½" (1.27 cm) solid steel rods having their lower end portions welded to the front end faces of the rails 4 near the front of the firebox 1. The upper end of each upright 5 is bent into a loop or eye 11. The uprights 5 serve to prevent falling or shifting logs from moving beyond the front of the log support 3 as well as serving to hold a hollow metal tube 14 which functions as an alarm.

Figure 4:
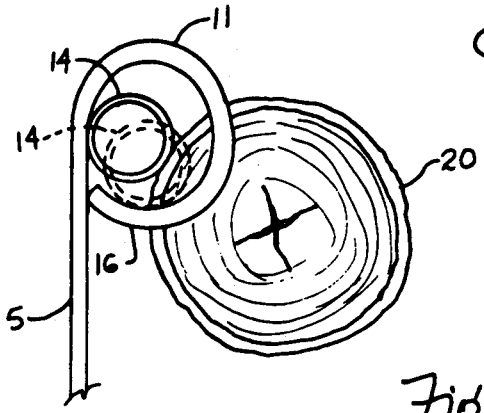
FIG. 4 is a detail view showing in phantom and full lines the displacement of the alarm mechanism within the support eyes as it is contacted by a shifted log

Referring now to FIG. 4 the operation of the alarm will be described in detail. The hollow metal tube 14 spans the uprights 5 and is loosely received within the eyes 11. The tube 14 may be of aluminum or steel or other suitable material and is normally at rest at the downwardly convex bottom 16 of the eyes 11 as is shown in FIG. 4 where the normal position of the tube is shown in phantom lines. When a forward shifting of a log or burnt fragment occurs, the log (illustrated at 20 in FIG. 4) will strike the uprights 5 or the tube 14. This contact by the log 20 displaces the hollow tube 14 from its rest position causing the tube to accelerate forwardly toward the uprights 5 and strike the uprights within the eyes 11 as shown by the full line illustration in FIG. 4.

This striking together of the hollow tube 14 and the solid metal bar stock from which the uprights are formed generates a loud sound. This noise propagated by the hollow metal tube beating against the eyes 11 may be heard by occupants of the home and so alert them that the fireplace needs attention. The potentially dangerous fire hazard may then be immediately alleviated by manually shifting the logs back into the firebox.

Figure 3:
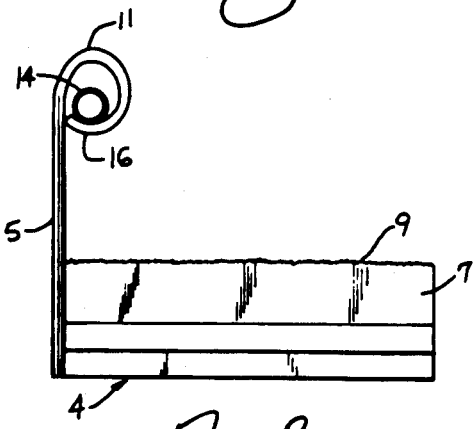
FIG. 3 is a side elevation of the preferred embodiment.

It is to be understood that metal tube 14 rests within the eyes 11 formed in uprights 5 in a loose fashion. The internal diameter of the loop or eye 11 is substantially greater than the exterior diameter of tube 14. The relative difference in size between eye 11 and tube 14 may be seen in FIG. 3. This space between eye 11 and tube 14 permits the acceleration of tube 14 to occur when it is struck by a moving log. The hollow nature of tube 14 allows the alarm noise to be generated with sufficient volume to be heard by occupants in other rooms of the house who cannot see the fireplace and observe the danger.

In operation the logs for burning are placed atop rails 4 and behind uprights 5. During the course of burning, as the combustion of the logs causes their size to change and shifting to occur, the logs will have a tendency to fall either forward or backward in the fireplace. If a log has fallen towards the back it is contained by the back wall 15 (FIG. 1) of the fireplace. If the logs fall forward they will contact either or both of the uprights 5 or tube 14. This movement by a log against one or both of the uprights or the tube will cause the tube 14 to shift within the eyes 11 and produce the loud alarm sound discussed above. The sound may be heard for some distance within a household and thereby alert the occupants that log shifting has occurred and that inspection of the fireplace is needed.

It should also be appreciated that the illustration in FIG. 4 of the action of the alarm of the present invention is intended to depict the common situation where a log burns through between its ends and a shortened fragment rolls forward. The partially burnt fragment is too short in length for its movement to be blocked by both of the uprights 5. Therefore, a particularly dangerous situation is presented which is immediately called to attention by the action of log fragment 20 striking the tube 14 to produce the audible warning.

It is to be understood that while a certain form of this invention has been illustrated and described, it is not limited thereto, except insofar as such limitations are included in the following claims.

Having thus described the invention, what is claimed as new and desired to be secured by Letters Patent is:

1. A fireplace log holder and alarm comprising:

log support means adapted to extend from the front to the rear of a firebox;

a pair of laterally spaced uprights on a front portion of said log support means, and each having an upper end provided with an eye; and a tubular member spanning the uprights and loosely received in said eyes of the uprights, whereby a falling log striking the uprights or the tubular member will cause the latter to strike the uprights within the eyes to generate a warning sound.

2. The device as claimed in claim 1, wherein said log support means comprises a pair of steel railroad rails having the head of each rail removed to present a rough, irregular surface adapted to support a log.

3. The device as claimed in claim 1, wherein the eye of each upright is a solid metal element integral therewith.

4. The device as claimed in claim 1, wherein said uprights are solid metal bars each having a lower end attached to said log support means and said upper end thereof bent to define the eye.

5. The device as claimed in claim 1, wherein said tubular member is metallic and presents a pair of open ends.

6. A fireplace log holder and alarm comprising:

a pair of transversely spaced, log-supporting railroad rails from which the rail head has been removed to present rough irregular surfaces for receiving logs, and each adapted to extend longitudinally from the front to the rear of a firebox;

a pair of laterally spaced metal uprights each having a lower end attached to a front end portion of a corresponding rail and an upper end bent to define an eye; and a metal tube open at either end, spanning said uprights and loosely received within said eyes thereof, whereby a falling log striking the uprights or the tube will cause the tube to strike the uprights within the eyes and generate a warning sound.

* * * * *